US009632459B2

(12) United States Patent
Katsumata

(10) Patent No.: US 9,632,459 B2
(45) Date of Patent: Apr. 25, 2017

(54) DEVELOPING DEVICE HAVING A FEEDING MEMBER WITH A PROJECTED PORTION

(71) Applicant: CANON KABUSHIKI KAISHA, Tokyo (JP)

(72) Inventor: Go Katsumata, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/001,445

(22) Filed: Jan. 20, 2016

(65) Prior Publication Data

US 2016/0209778 A1 Jul. 21, 2016

(30) Foreign Application Priority Data

Jan. 21, 2015 (JP) ..... 2015-009251

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/08
USPC ..... 399/254
See application file for complete search history.

(56) References Cited

U.S. PATENT DOCUMENTS

2011/0243612 A1* 10/2011 Hosokawa ..... G03G 15/0822 399/252

FOREIGN PATENT DOCUMENTS

| | | | |
|---|---|---|---|
| JP | H11-109734 | A | 4/1999 |
| JP | 2002-072686 | A | 3/2002 |
| JP | 2010-237328 | A | 10/2010 |

* cited by examiner

*Primary Examiner* — Quana M Grainger
(74) *Attorney, Agent, or Firm* — Fitzpatrick, Cella, Harper & Scinto

(57) ABSTRACT

A developing device includes a developer carrying member for carrying a two component developer, a first feeding member rotatably provided in a first chamber, and a second feeding member rotatably provided in a second chamber. The second feeding member includes a first spiral portion, a second spiral portion provided downstream of the first spiral portion, a disk portion provided downstream of the second spiral portion, and a shaft portion provided downstream of the second spiral portion. A stepped portion is provided in the second chamber at a position downstream of the disk portion and upstream of a discharge opening and has a height high enough to oppose a lateral surface of the disk portion. In addition, a projected portion projects from a part of the disk portion that opposes the stepped portion.

8 Claims, 8 Drawing Sheets

(a)

(b)

(a)

(b)

DEVELOPING DEVICE HAVING A FEEDING MEMBER WITH A PROJECTED PORTION

FIELD OF THE INVENTION AND RELATED ART

The present invention relates to a developing device which internally stores two-component developer made up of toner and carrier.

Most image forming apparatuses which use an electrophotographic image forming method or an electrostatic recording method, in particular, those which form full-color images and multicolor images with the use of an electrophotographic image forming method, employ a developing device which uses two-component developer, which is a mixture of toner and carrier.

As has been well known, a developing method which uses two-component developer charges toner with the use of friction between the carrier and toner, and forms an image by electrostatically adhering the charged toner to a latent image. In order to ensure that an image forming apparatus which uses the above-described developing method which uses two-component developer, continuously outputs high quality images for a long time, it is important to ensure that the developing device employed by the apparatus remains stable in the amount by which toner is given triboelectric charge. Thus, it is important that the carrier in the developing device remains stable in its ability to provide the toner in the developing device, with triboelectric charge.

In reality, however, with the increase in the cumulative length of usage of an image forming apparatus, the carrier in the developing device in the image forming apparatus reduces in its ability to provide the toner with triboelectric charge. More concretely, the toner in a developing device is continuously consumed by the developing process, whereas the carrier is not, and therefore, remains in the developing device. Thus, as an image forming apparatus is used for a long period of time, the carrier is stirred along with the toner for a long period of time. As a result, the carrier is contaminated; the toner and the external additive of toner adhere to the surface of a carrier particle. Consequently, the carrier reduces in its ability to provide the toner with a sufficient amount of triboelectric charge. If the carrier fails to provide the toner with a sufficiently amount of triboelectric charge, the image forming apparatus is likely to output unsatisfactory images such as foggy images attributable to scattering of toner.

Thus, in order to deal with the above-described issue, it has been proposed to replenish a developing device with two-component developer (developer which contains carrier) to prevent the developing device from reducing in its toner charging performance.

It is proposed in Japanese Laid-open Patent Application No. 2002-72686 (Patent document 1), for example, to structure a developing device so that as an image forming operation continues, the developing device is replenished with two-component replenishment developer, which is a mixture (preset ratio) of toner and carrier, and the excess amount of developer in the developing device is discharged through the developer outlet with which the developer container of the developing device is provided. Next, referring to FIG. 2, the developing device disclosed in Patent document 1 is briefly described.

The developing device is provided with: a developer container 11; and first and second conveyance screws 14 and 15 which cause the developer in the developer container 11 to circulate in the developer container 11. The developer container 11 is provided with a developer discharge passage 11*c* through which the developer in the developer container 11 can be discharged. More specifically, the downstream end of the developer container 11 in terms of the direction (indicated by arrow mark B) in which the developer is conveyed by the second conveyance screw 15 is provided with the developer discharge passage 11*c*. In FIG. 2, the developer discharge passage 11*c* is behind the collar-like section 154 of the second conveyance screw 15. Further, the second conveyance screw 15 is provided with a first spiral section 151 and a second spiral section 152. The first spiral section 151 conveys the developer toward the developer discharge passage 11*c* to cause the developer to circulate. The second spiral section 152 is on the downstream side of the first spiral section 151 in terms of the direction in which the first spiral section 151 conveys the developer. It is in connection to the first spiral section 151. The direction in which the developer in the developer container 11 is conveyed by the second spiral section 152 is opposite from that by the first spiral section 151.

Thus, as the second conveyance screw 15 is rotated, the first spiral section 151 conveys the developer in the developer container 11 toward the developer discharge passage 11*c*. However, the developer conveyed by the first spiral section 151 is mostly pushed back by the second spiral section 152 to prevent the developer in the developer container 11 from being discharged by an excessive amount.

To describe in greater detail the developing device disclosed in the abovementioned Patent document 1, about its structure for discharging the excessive amount of developer, in a case where the developer container 11 is continuously replenished with developer from an unshown developer replenishment unit, the developer container 11 increases in the amount of the developer therein. Thus, the top surface of the body of developer in the developer container rises. Consequently, the amount by which the developer is pushed back by the second spiral section 152 becomes smaller than the amount by which the developer is conveyed by the first spiral section 151. Thus, the excessive amount of developer moves beyond the second spiral section 152 toward the developer discharge passage 11*c*.

The portion of the excessive amount of developer, which moved past the second spiral section 152 by overcoming the backward push generated by the second spiral section 152, is conveyed to the developer discharge passage 11*c* by the third spiral section 153 (FIG. 5) which is the same in the developer conveyance direction as the first spiral section 151, and which is in connection to the upstream side of the second spiral section 152. Therefore, the body of developer in the developer container becomes stable at a certain value (maximum saturation value); the amount of the developer in the developer container becomes stable at a certain value (maximum saturation value).

On the other hand, in a case where the amount by which the developer container is replenished with developer is smaller than a certain value, or the developer container is not replenished with developer for a certain length of time, the developer container gradually reduces in the amount of developer therein. Therefore, the top surface of the body of developer in the developer container lowers. However, as the developer container reduces in the amount of developer therein by a certain value, and therefore, the top surface of the body of developer in the developer container lowers, the amount by which the developer is pushed back by the second spiral section 152 becomes larger than the amount by which the developer is conveyed by the first spiral section 151. Consequently, it does not occur that the excessive amount of developer moves beyond the second spiral section 152 by overcoming the backward pressure generated by the second spiral section 152. Therefore, the amount by which the developer is discharged from the developer container 11 reduces. Therefore, the top surface of the body of developer in the developer container does not become lower than a certain level. That is, the amount of the developer in the developer container does not become smaller than a certain value (minimum saturation value).

Therefore, in a case where a developing device is structured as described above, the amount of developer in the developing device fluctuates while remaining between the maximum value and minimum value. However, if the amount of the developer in the developing device is excessive, the developer is insufficiently stirred, resulting in such a problem that an image forming apparatus outputs images which are nonuniform and/or foggy, and also, that the developer overflows from the developer container. On the other hand, in a case where the developing device is excessively small in the amount of developer therein, the amount by which developer is supplied to develop an electrostatic latent image becomes insufficient. Consequently, an image forming apparatus outputs images which are nonuniform in density, and/or images having unwanted white spots. Thus, it is important that the amount by which the amount of the developer in the developer container of the developing device fluctuates is kept within a proper range.

Patent document 1 proposes to structure a developing device so that even if the rotational speed of the conveyance screw is changed by the change in the process speed of an image forming apparatus, the amount by which developer is discharged from the developer container of the developing device is kept stable to prevent the developer container of the developing device from changing in the amount of the developer therein.

More specifically, according to Patent document 1, a collar-like section 154 is connected to the developer discharge passage side of the second spiral section 152 so that the valley section of the second spiral section 152 is not exposed toward the developer discharge outlet. With the employment of this structural arrangement, it is possible to prevent the problem that as the valley section of the spiral section is exposed toward the developer discharge outlet, the amount by which the developer is discharged is changed by the rotational phase of the valley section of the spiral section, in particular, when the conveyance screw is high in rotational speed.

Japanese Laid-open Patent Application No. 2010-237328 (Patent document 2) proposes to structure a developing device so that even if the developer in the developing device reduces in fluidity due to a continuous long operation of an image forming apparatus, and/or change in the environment in which the apparatus is operated, the developing device is prevented from excessively reducing in the amount by which the developer is discharged therefrom. More specifically, the second spiral section 152 is provided with a protrusion (appendage), which protrudes from the developer discharge outlet side of the collar-like section 154 of the second spiral section 152, and which rotates with the collar-like section 154. Thus, the developer collects in the adjacencies of the collar-like section due to the reduction in the fluidity of the developer, and therefore, the developer discharge interferes with the developer having collected in the adjacencies of the collar-like section 154. The collected developer is scraped away by the protrusion, and therefore, the developing device is enabled to remain stable in the amount by which the developer is discharged.

However, in a case where a developing device is structured, as disclosed in Patent document 2, so that the collar-like (disc-like section) section 154 of the second conveyance screw 15 is provided with a protrusion, as the developing device was subjected to tests in which it was continuously operated for a substantial length of time in an environment which was high in temperature and humidity, the developing device sometimes reduced by a substantial amount in the amount by which it discharged the developer. Thus, the developing device was precisely studied in terms of developer flow in the developer container of the developing device. The studies resulted in the discovery of the occurrence of the following phenomenon.

That is, as the developer reduced in fluidity, it collected in the adjacencies of the collar-like section of the second spiral section 152. Then, as the developer collected, the protrusion on the developer discharge outlet side of the collar-like section scraped away the collected developer. However, there was another area, more specifically, a space H1 (area H1 in FIG. 3, and area H2 in FIG. 5), which is between the surface of the collar-like section 154, which faces the developer discharge passage, and the rear end of the developer container, in which the developer collected, and the collected developer prevented the developer from smoothly discharged from the developer container.

SUMMARY OF THE INVENTION

The present invention is related to the further improvement of the above-described conventional arts. The object of the present invention is to provide a developing device structured to ensure that as the developer in the developer container of the developing device is moved downstream by a certain amount beyond the collar-like (disc-like) section of the secondary spiral section, the developer is smoothly conveyed to the developer discharge outlet, so that the excessive amount of developer in the developer container is properly discharged, even if the developing device is continuously operated in an environment which is high in temperature and humidity.

According to an aspect of the present invention, there is provided a developing device comprising a first chamber configured to accommodate a two component developer comprising toner and carrier; a second chamber in fluid communication with said first chamber to constitute a circulation path along which the developer circulates; a partition partitioning between said first chamber and said second chamber; a developer discharging path provided downstream of said second chamber with respect to a feeding direction of the developer and having a bottom surface at the position higher than a bottom surface of said second chamber, said developer discharging path constituting a feeding path for discharging the developer; a first feeding member rotatably provided in said first chamber and configured to feed the developer; and a second feeding member rotatably provided in said second chamber and configured to feed the developer, said second feeding member including a first spiral portion configured to feed the developer toward said developer discharging path, a second spiral portion provided downstream of said first spiral portion in a position downstream of the feeding direction, and a disk portion provided opposed to said developer discharging path in a position downstream of said second spiral portion with respect to a feeding direction of said first spiral portion, second spiral portion having a direction of helicity which is different from that of said first spiral portion, wherein said disk portion is provided with a projected portion extending from a developer discharging path side surface in an axial direction of said second feeding member, said projected portion being disposed in a range outside of an area of said developer discharging path projected in the axial direction of said second feeding member.

Further features of the present invention will become apparent from the following description of exemplary embodiments with reference to the attached drawings.

Figure 6:
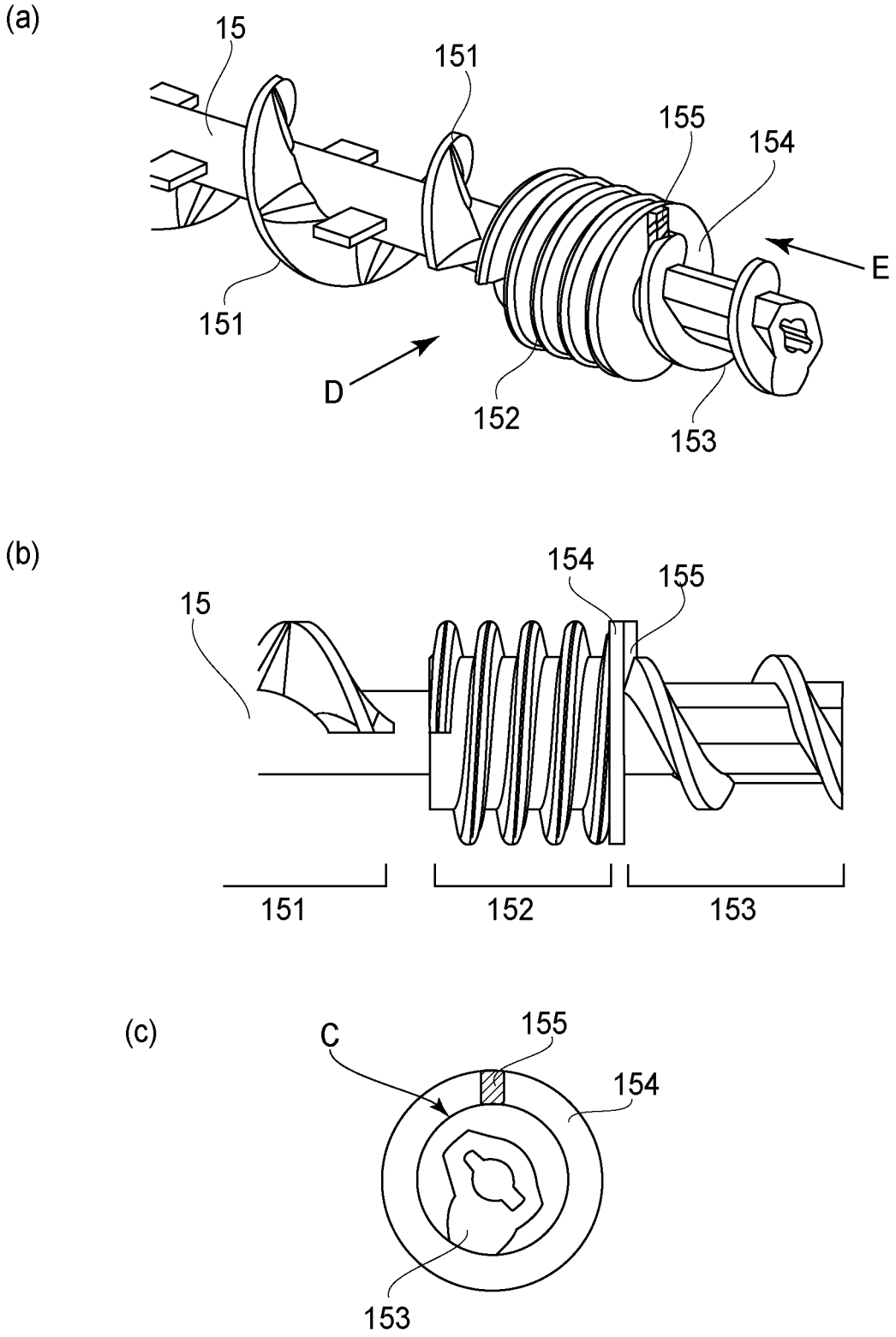

Parts (a), (b) and (c) of FIG. 6 are views of the device according to the first embodiment.

Figure 7:
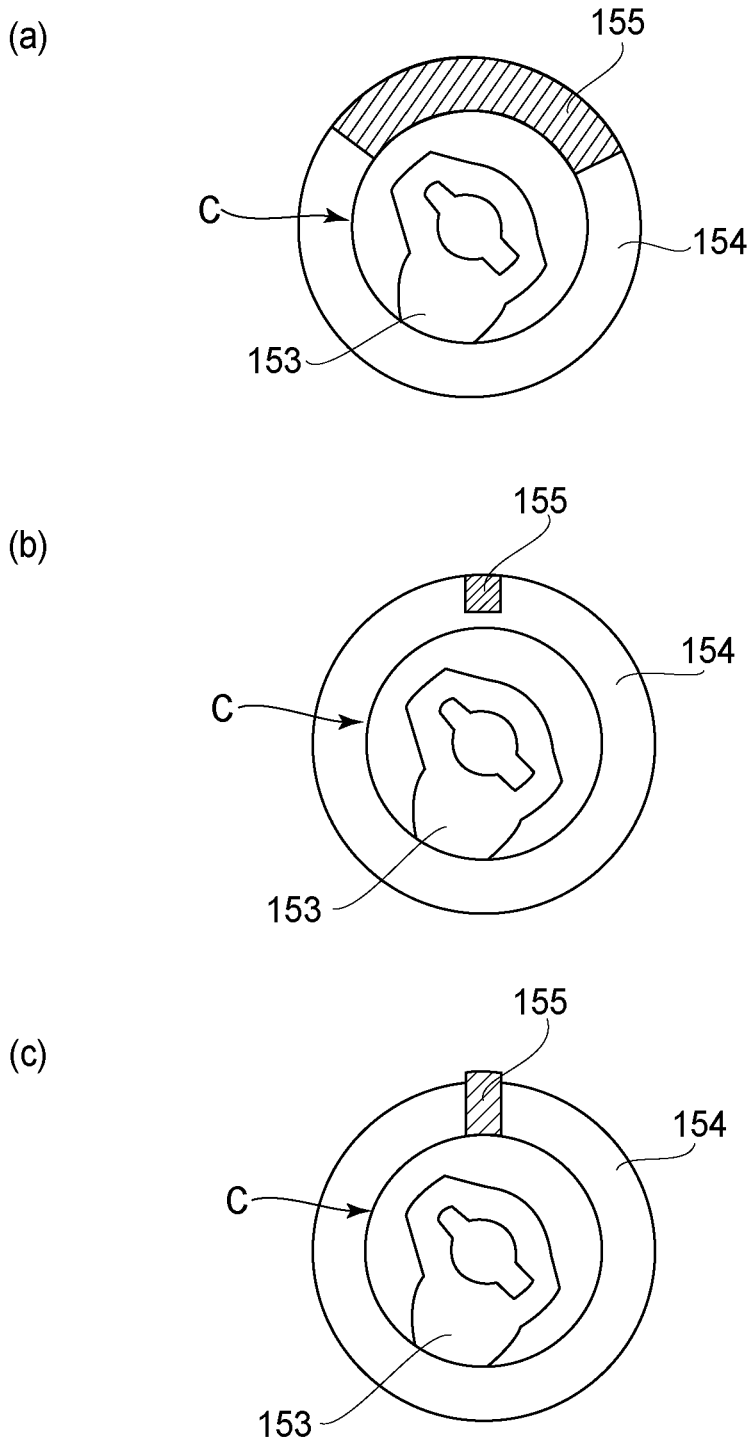

Parts (a), (b) and (c) of FIG. 7 are axial views of the disk in the first embodiment.

Figure 8:
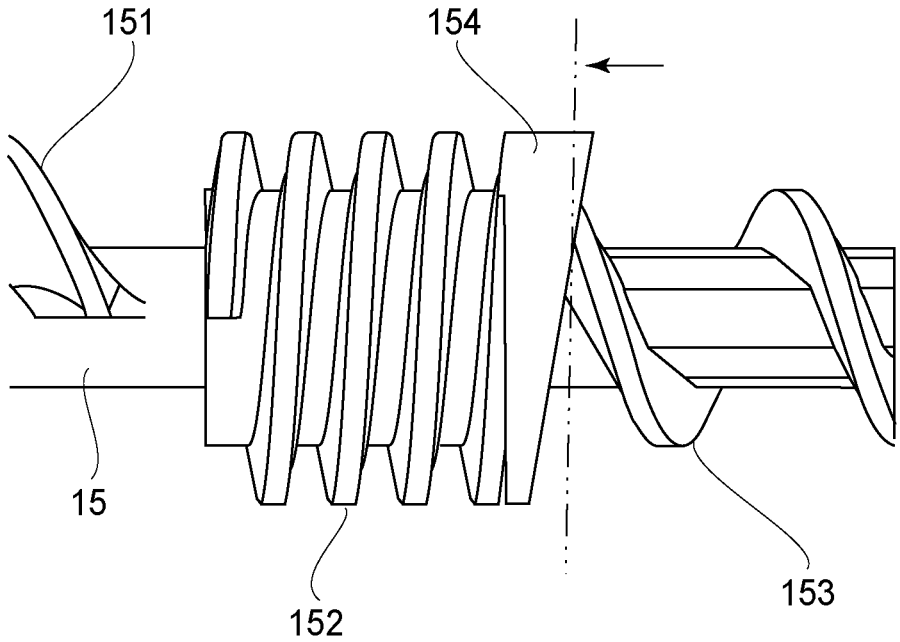
Figure 8:
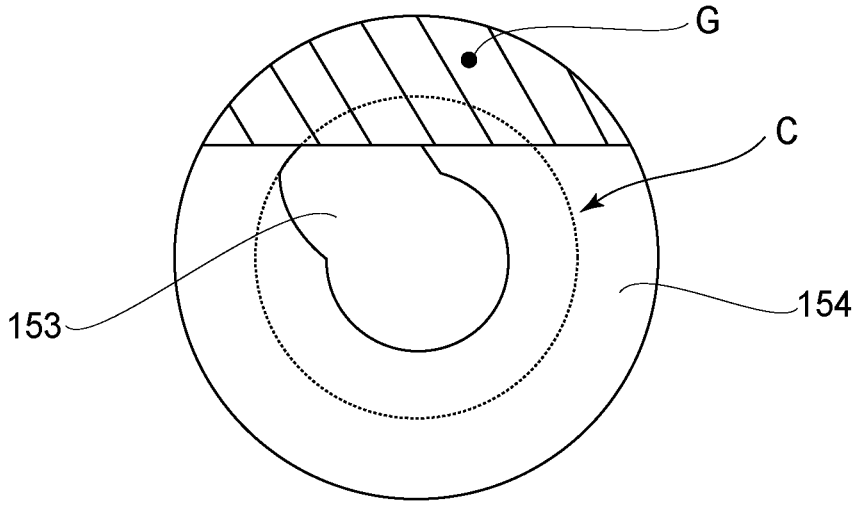

Parts (a) and (b) of FIG. 8 are views of the device according to the second embodiment of the present invention.

Figure 9:
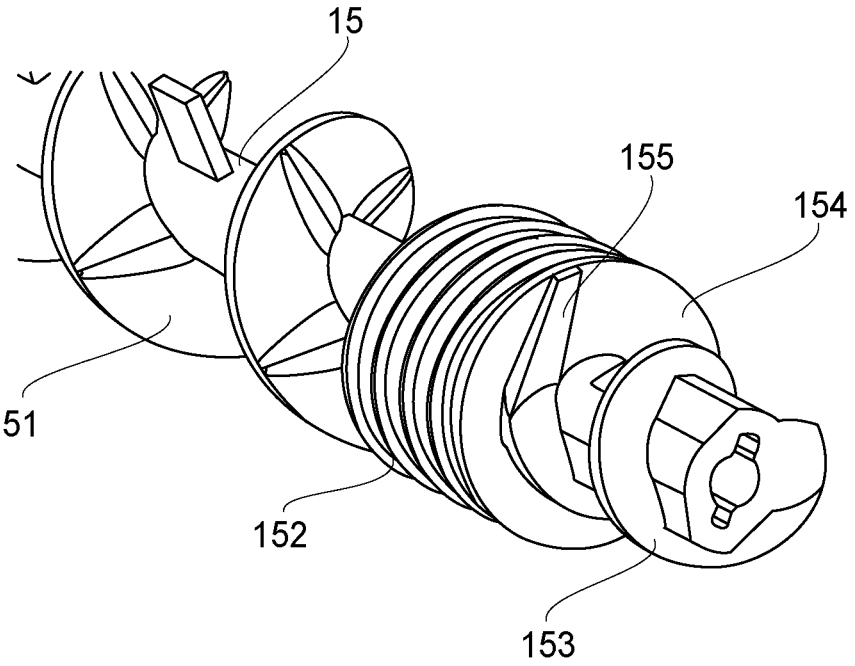
Figure 9:
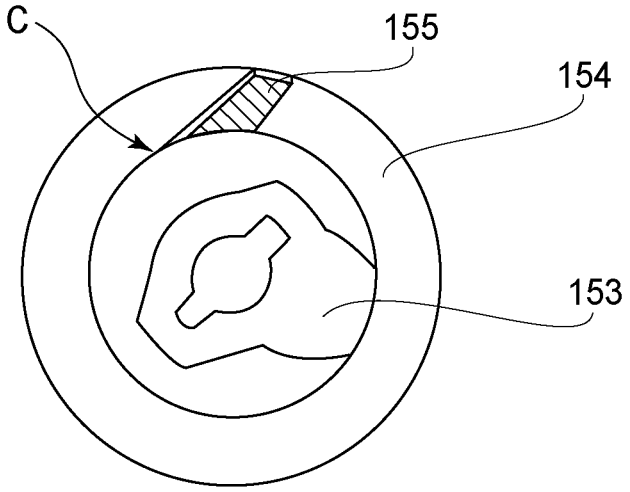

Parts (a) and (b) of FIG. 9 are views of the screw in the third embodiment of the present invention.

DESCRIPTION OF THE EMBODIMENTS

Hereinafter, a few of the preferred embodiments of the present invention are described.

(Image Forming Apparatus)

Figure 1:
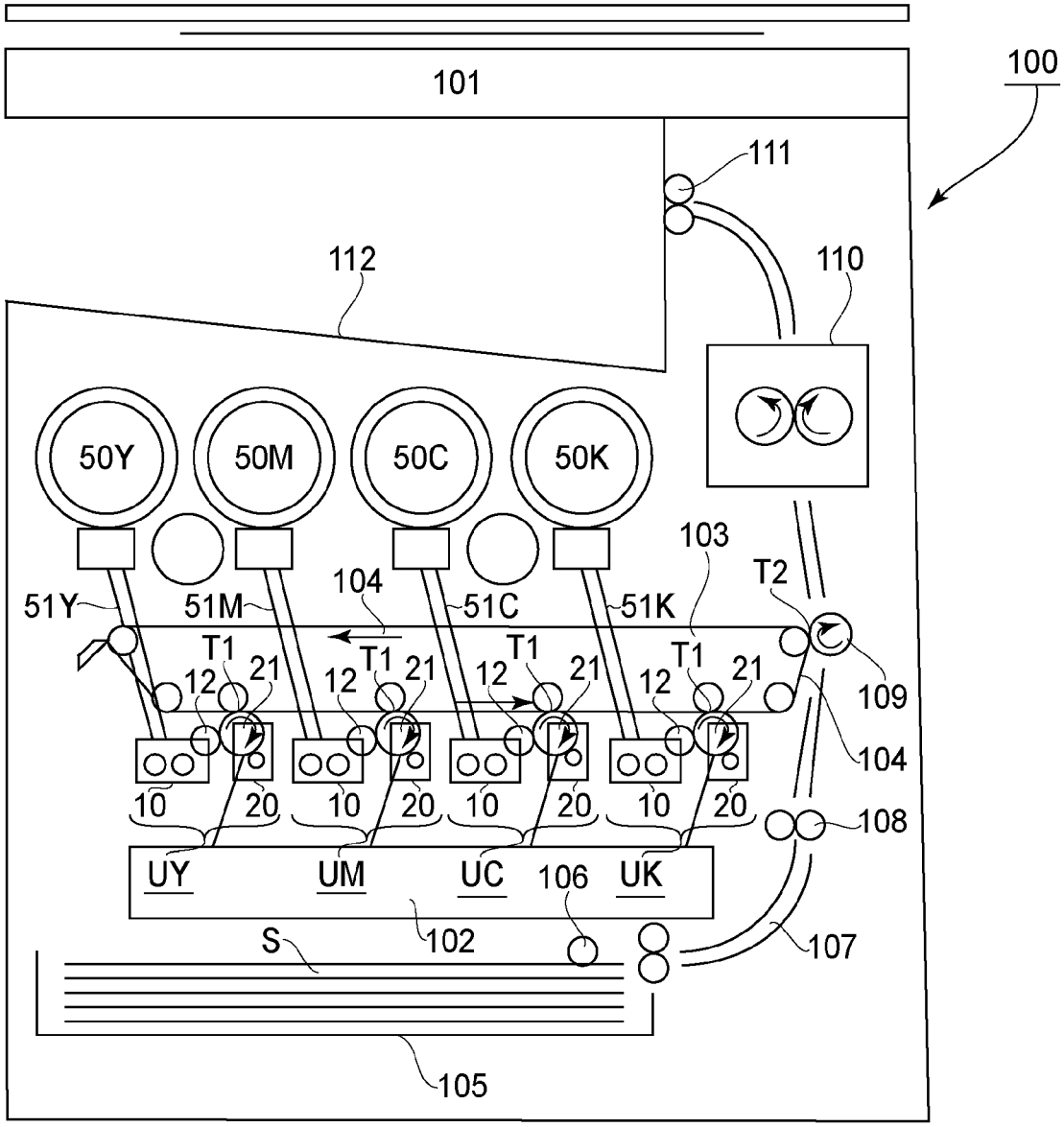
FIG.1 (Prior Art)
FIG. 1 is a schematic sectional view of a typical image forming apparatus to which the present invention is applicable.

FIG. 1 is a schematic drawing of one of the typical image forming apparatuses to which the present invention is applicable. The image forming apparatus 100 in FIG. 1 is an electrophotographic digital copying machine of the so-called intermediary transfer type, and also, of the so-called tandem type. It is capable of forming full-color images with the use of four toners which are different in color. That is, it is capable of forming a full-color toner image on a sheet S of recording medium, and outputs the sheet S. The essential structure of this apparatus 100, and the electrophotographic process used by the apparatus 100, are well known. Therefore, they will be described only briefly.

The apparatus 100 has a reading section 101 (reader section) which reads an original. There are four processing units U (UY, UM, UC and UK), a laser scanner unit 102 as an exposing means, and an intermediary transfer belt 103, in the main assembly of the apparatus 100. The four processing units U are aligned roughly in parallel in the left-to-right direction of the drawing.

Each processing unit U has a drum unit 20 and a developing unit 10 (developing device). The drum unit 20 is equipped with an electrophotographic photosensitive drum 21 which is an image bearing component, whereas the developing unit 10 is equipped with a developer bearing component 12 (development roller, development sleeve). Further, the drum unit 20 has also a charge roller (unshown) as a processing means which processes the drum 21, and a cleaning device (unshown). The developing unit 10 of each processing unit U contains two-component developer, which is a mixture of toner and carrier. The four developing units U are the same in structure although they are different in the color of the toner of the developer they contain.

In the case of this example of an image forming apparatus, the color of the toner in the developer in the developing unit 10 of the processing unit UY is yellow (Y). Thus, the developing unit UY forms a yellow toner image on its drum 21. The color of the toner in the developer in the developing unit 10 of the processing unit UM is magenta (M). Thus, the developing unit UM forms a magenta toner image on its drum 21. The color of the toner in the developer in the developing unit 10 of the processing unit UC is cyan (C). Thus, the developing unit UC forms a cyan toner image on its drum 21. The color of the toner in the developer in the developing unit 10 of the processing unit UK is black (K). Thus, the developing unit UK forms a black toner image on its drum 21.

Then, the above-mentioned four monochromatic images which are different in color, are sequentially transferred in layers (primary transfer) onto the belt 104 of an intermediary transfer belt unit 103, in the primary transfer nip T1, which is the area of contact between the drum 21 and belt 104, effecting thereby a full-color toner image on the belt 104. Then, the full-color toner image is transferred (secondary transfer) onto a sheet S of recording medium, in the secondary transfer nip T2, which is the area of contact between the belt 104 and the secondary transfer roller 109.

More concretely, a sheet cassette 105 contains in layers multiple sheets S of recording medium. The sheets S are fed one by one into the apparatus main assembly by a sheet feeding-conveying roller 106, while being separated from the rest. Then, each sheet S is conveyed upward in the apparatus main assembly, through the sheet conveyance passage 107. Then, the sheet S is introduced by a pair of registration rollers 108, into the secondary transfer nip T2, in which the full-color toner image is transferred (secondary transfer) onto the sheet S. Then, the sheet S is introduced into a fixing device 110, through which the sheet S is conveyed, remaining pinched by a pair of fixing components of the device 110. Consequently, the full-color toner image becomes fixed to the sheet S. Then, the sheet S is discharged as a full-color print into a delivery tray 112 by a pair of discharge rollers 111.

In a case where the image forming apparatus 100 is operated in the monochromatic mode, only the process unit(s) U necessary for the formation of a monochromatic image of a specific color is activated. That is, the drums 21 in the other process units U are let idle; they are not used for image formation.

A referential code 50 stands for each of the four developer cartridges (50Y, 50M, 50C and 50K) which contain two-component replenishment developer (developer created by mixing carrier into toner by a preset ratio), with which the developing unit 10 of the processing unit U is to be replenished. The image forming apparatus 100 is structured so that the four developer cartridges 50 can be removably installable in parallel into the development cartridge chambers, one for one, which are above the intermediary transfer belt unit 103.

As each developer cartridge 50 is installed into the apparatus main assembly, it becomes connected to the developing unit 10 of the corresponding processing unit U, through the corresponding developer replenishment unit 51 (51Y, 51M, 51C or 51K) which is in the rearmost end of the internal space of the apparatus main assembly 10A (which corresponds to back side of sheet of paper on which FIG. 1 is present). Then, as the developer replenishment unit 51 is driven while being controlled in a preset manner, the developer container of the developing unit 10 is replenished with the developer from the developer cartridge 50, with proper timing, by a proper amount.

(Developing Unit)

Figure 2:
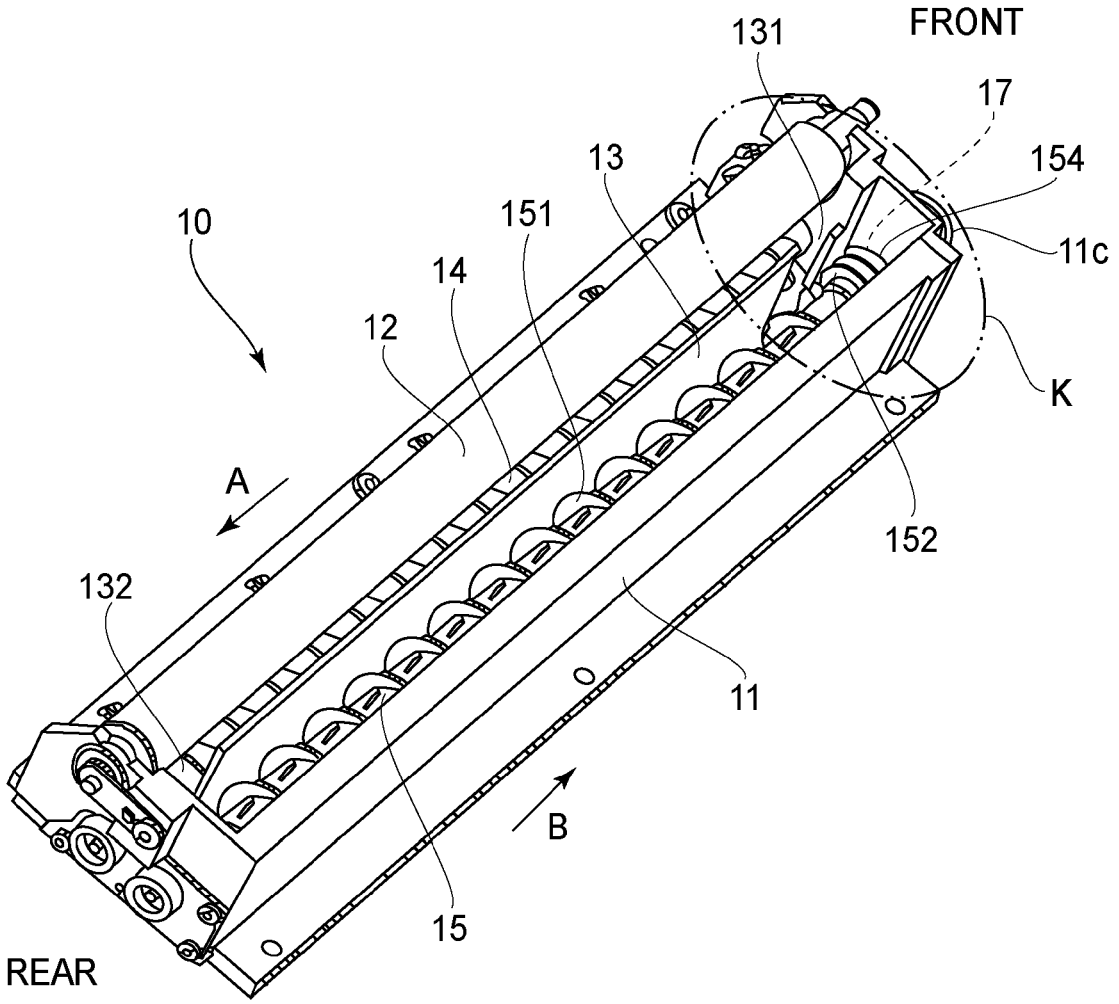
FIG.2 (Prior Art)
FIG. 2 is a perspective view of a typical developing unit (developing device) to which the present invention is applicable.

As described above, the four process units U are the same in structure although they are different in the color of the toner in the two-component developer they contain. FIG. 2 is a perspective view of one of the developing units 10, as seen from a point which is above the rear end of the apparatus main assembly 10A when the unit 10 is in the apparatus main assembly.

The developing unit 10 has: a developer container 11 which has a developer chamber in which two-component developer is contained; and a developer bearing component 12 for developing an electrostatic latent image. Further, the developing unit 10 has a partitioning wall 13, which extends in the lengthwise direction of the developer chamber in a manner to partition the developer chamber into two sections (sub-chambers).

The developer container 11 contains a first conveyance screw 14 (first developer conveying component) as the means for conveying developer while stirring the developer, and a second conveyance screw 15 (second developer conveying component), with the presence of the partitioning wall between the two screws 14 and 15.

The first conveyance screw 14 is in the bottom portion of one of the abovementioned sub-chambers of the developer container 11, which is on the same side, as the developer bearing component 12, of the partitioning wall 13, being disposed roughly parallel to the axial line of the developer bearing component 12. It conveys the developer in the direction parallel to its axial line by being rotated.

The second conveyance screw 15 is in the bottom portion of the other sub-chamber of the developer container 11, that is, the sub-chamber which is on the opposite side of the partitioning wall 13, being disposed roughly parallel to the first conveyance screw 14. As for the primary direction in which the second conveyance screw 15 conveys the developer, it is opposite from the direction in which the developer is conveyed by the first conveyance screw 14. That is, it conveys the developer by its first spiral section 151 in the direction indicated by an arrow mark B.

That is, the developer in the developer container 11 is circularly (alternately in directions A and B) conveyed by the rotation of the first and second conveyance screws 14 and 15, with the presence of the partitioning wall 13, and the presence of the front and rear openings 131 and 132 of the partitioning wall 13.

Figure 4:
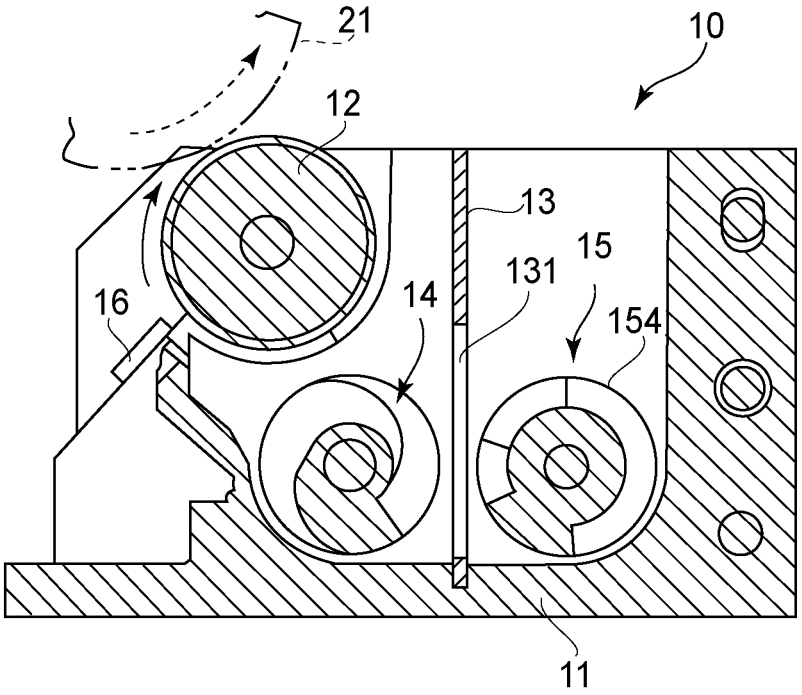
FIG. 4 is a schematic sectional view of the developing unit at a plane which is perpendicular to the lengthwise direction of the developing unit.

As the developer is conveyed, while being stirred, in the developer container 11 by the first conveyance screw 14, a part of the body of developer in the developer container 11 is borne by the peripheral surface of the developer bearing component 12 which is being rotationally driven. The amount (volume per unit area) by which the developer is borne by the developer bearing component 12 is regulated by a regulating component 16 (FIG. 4). Then, the toner in the developer on the peripheral surface of the developing bearing component 12 is allowed to be adhered to the electrostatic latent image on the drum 21 of the drum unit 20, in the developing section (area of contact between drum 21 and developer bearing component 12). Consequently, the latent image on the drum 21 is developed into a visible image, that is, an image formed of toner.

The residual developer on the developer bearing component 12, that is, the developer which is remaining on a given section of the peripheral surface of the developer bearing component 12 after the given section was conveyed through the developing section to be used for the development of the latent image, is returned to the developer container 11 by the subsequent rotation of the developer bearing component 12, and then, is removed from the developer bearing component 12. After the removal of the residual developer from the developer bearing component 12, the developer bearing component 12 is supplied again with the developer. The removed developer mixes into the developer in the developer container 11, and continues to circularly move through the developer container 11.

(Mechanism for Discharging Excessive Amount of Developer)

As described above, as the replenishment developer unit 51 is driven while being controlled in a preset manner, the developer container 11 of the developing unit 10 is replenished with two-component replenishment developer with proper timing, by a proper amount, from the corresponding developer cartridge 50. As the amount of the developer in the developer container 11 becomes excessive due to this replenishment, the excessive amount of the developer in the developer container 11 is discharged by a trickle developer replenishment system, ACR (automatic carrier refresh).

Thus, the old carrier in the developer in the developer container 11 is gradually replaced by fresh carrier. Therefore, it is unlikely for deteriorated (old) carrier to permanently remain in the developer container 11. Thus, it can be prevented that the carrier in the developer container 11 reduces in toner charging performance.

Figure 3:
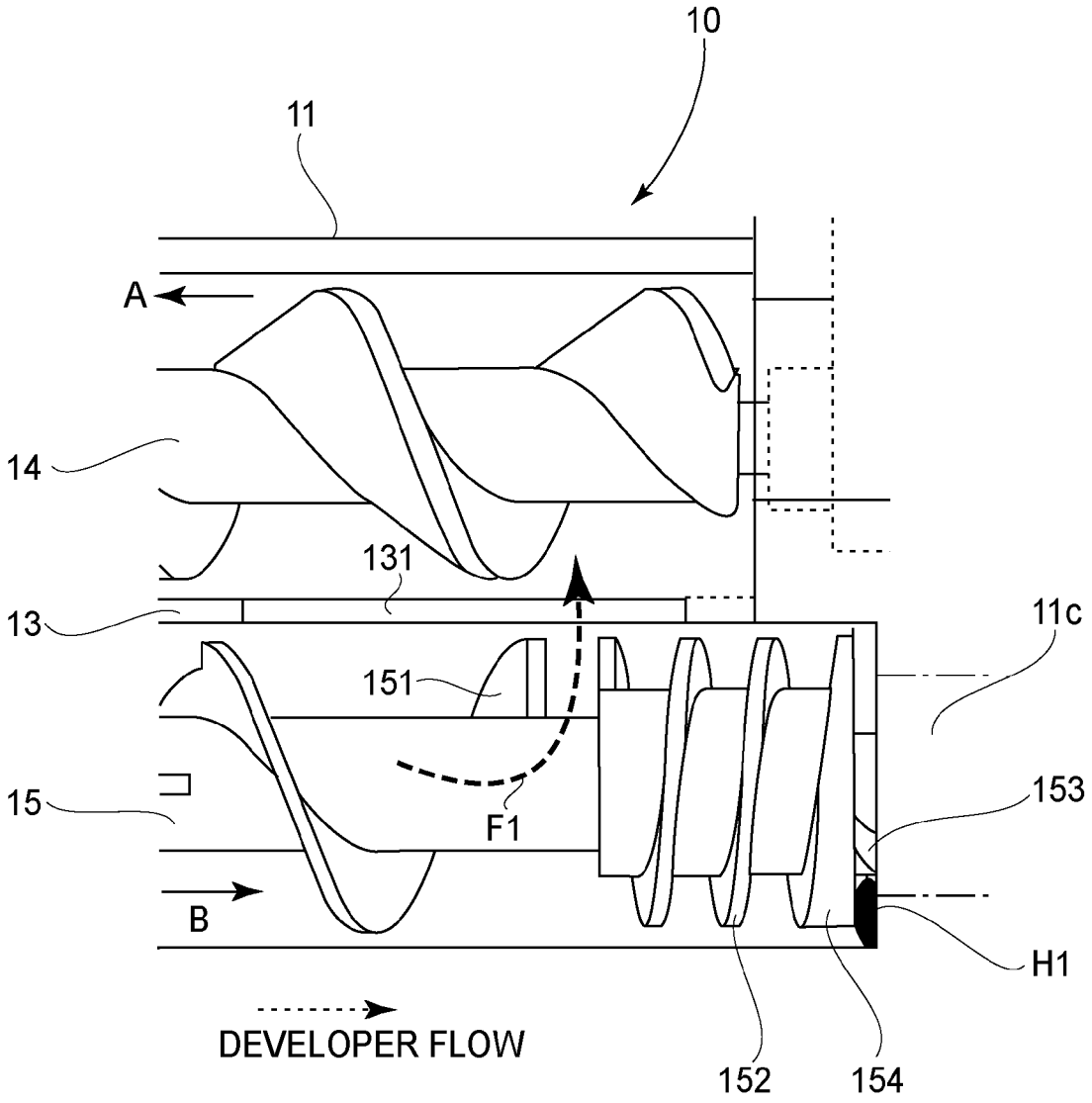
FIG. 3 is a schematic top view of the adjacencies of the developer discharge passage entrance of the developing unit.
Figure 5:
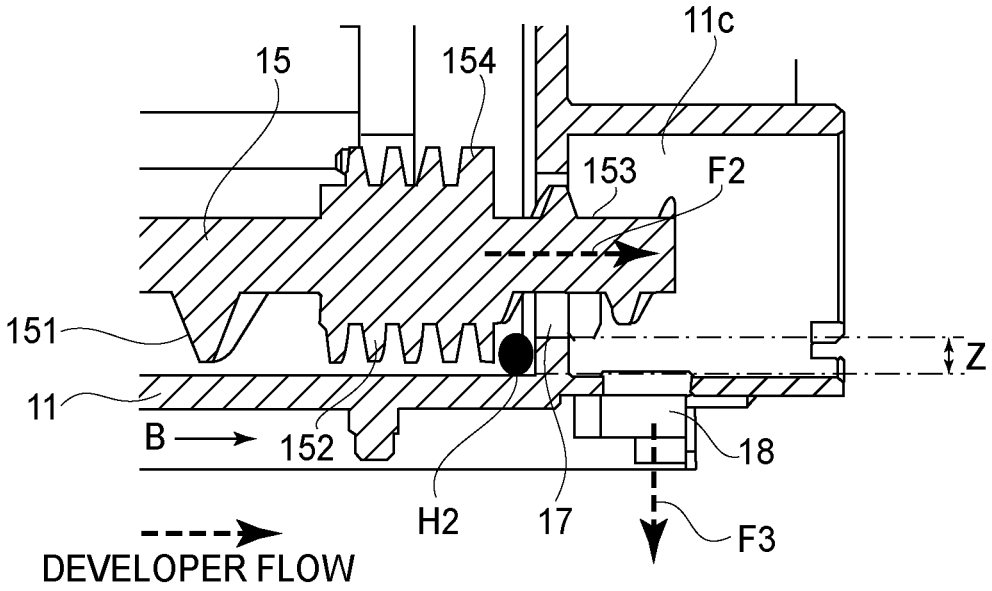
FIG. 5 is a sectional view of the device according to the first embodiment of the present invention.

Next, referring to FIGS. 3-5, the mechanism for discharging an excessive amount of developer from the developer container 11 is described. FIG. 3 is a top view of the area K surrounded by a two-dot chain line in FIG. 2, that is, the adjacencies of the collar-like (disc-like) section 154 (which will be described later) of the second conveyance screw 15, and its adjacencies. FIG. 4 is a sectional view of the collar-like section 154 and its adjacencies, at a plane which is perpendicular to the rotational axis of the second conveyance screw 15. FIG. 5 is a sectional view of the front opening 131 of the partitioning wall 13, and its adjacencies, at a vertical plane which coincides with the rotational axis of the second conveyance screw 15.

The second conveyance screw 15 has the first spiral section 151 (conveyance screw) which conveys the developer in the direction B, that is, toward the developer discharge passage 11*c*. Further, the second conveyance screw 15 has the second spiral section 152, which is on the downstream side of the first spiral section 151 in terms of the developer conveyance direction of the first spiral section 151. The second spiral section 152 is opposite in the angle of the spiral blade. The second spiral section 152 conveys the developer in a manner of pushing the developer from outside the normal developer circulation path, into the normal developer circulation path. That is, its pushes the developer in the opposite direction from the direction in which the developer is conveyed toward the developer discharge passage 11*c*.

Further, the partitioning wall 13 is provided with the front opening 131, which corresponds in position to the joint between the first spiral section 151 and second spiral section 152.

Further, the upstream wall of the developer container 11 in terms of the developer conveyance direction of the second spiral section 152 is provided a discharge passage entrance 17. Moreover, on the outward side of the discharge passage entrance 17, the developer discharge passage 11*c*, and a discharge outlet 18 for discharging the developer out of the developer container 11, are provided.

Thus, as the developer is conveyed toward the discharge passage 11*c* by the first spiral section 151 of the second conveyance screw 15, most of the developer is pushed back by the second spiral section 152, escaping thereby from being discharged through the discharge passage entrance 17. As the developer escapes from being discharged, it is transferred onto the first conveyance screw 14 through the front opening 131 of the partitioning wall 13 (flow indicated by arrow mark F1 in FIG. 3).

The second conveyance screw 15 is also provided with the third spiral section 153 (discharge screw), which conveyed the developer in the developer discharge passage 11*c*, in the same direction as the first spiral section 151. The developer which was not pushed back by the second spiral section 152 moves through the discharge passage entrance 17 (flow indicated by arrow mark F2 in FIG. 5). Then, it is discharged, as excessive amount of developer, out of the developer container 11 through the outlet 18 (flow indicated by arrow mark F3 in FIG. 5).

Further, the second conveyance screw 15 is provided with the collar-like (disk-like) section 154, which is on the upstream side of the second spiral section 152 in terms of the developer conveyance direction of the second spiral section 152, being positioned so that it covers the discharge passage entrance 17. That is, the collar-like section 154 is on the downstream side of the second spiral section 152 in terms of the developer conveyance direction of the first spiral section 151, and directly faces the developer discharge passage 11*c*.

The bottom surface of the developer discharge passage 11*c* is positioned higher in terms of the gravity direction than the bottom surface of the developer chamber of the developer container 11. Referring to FIG. 5, the bottom surface of the developer discharge passage 11*c* is positioned higher by a height Z than the bottom surface of the developer chamber. If the bottom surface of the developer discharge passage 11*c* is not positioned higher by the height Z than the bottom surface of the developer chamber, it is possible that the developer is discharged by a greater amount than otherwise, and therefore, the developer in the developer container 11 will reduce in amount. Therefore, the developing device is structured so that the projection of the developer discharge passage 11*c* upon the collar-like section 154 is smaller in size than the collar-like section 154.

That is, the developer container 11 has the developer chamber, and the developer discharge passage 11*c*, and the bottom surface of the developer discharge passage 11*c* is positioned higher than the bottom surface of the developer chamber. In other words, the second conveyance screw 15 has the above-described first spiral section 151, second spiral section 152, third spiral section 153, and collar-like section 154 which directly faces the developer discharge passage 11*c*. These sections are in connection to each other in the listed order.

The collar-like section 154 has the function of reducing the difference in inertia between the developer conveyed toward the discharge passage entrance 17 by the first spiral section 151 of the second conveyance screw 15, and the developer pushed back by the second spiral section 152 of the second conveyance screw 15, that is, the difference attributable to the difference in developer conveyance performance between the first and second spiral sections 151 and 152. The collar-like section 154 stabilizes the amount by which the developer is discharged, by making it impossible for the developer to move into the discharge passage entrance 17 from the upstream end of the second spiral section 152 in terms of the developer conveyance direction of the second spiral section 152. The collar-like section 154 covers the upstream end of the second spiral section 152, that is, the end of the second spiral section 152, which directly faces the discharge passage entrance 17, to prevent the valley portion of the spiral blade from exposed toward the discharge passage entrance 17.

Thus, even if the second conveyance screw 15 changes in rotational speed, it is ensured that the amount by which the developer is discharged from the developer container 11 remains stable.

However, in the case of a conventionally structured developing device, as the developer collects in the adjacencies of the discharge passage entrance 17, it becomes stagnant in a space H (area H1 in FIG. 3, and area H2 in FIG. 5) between the surface of the collar-like section 154, which directly faces the discharge passage entrance 17, and the inward surface of the wall having the discharge passage entrance 17. More specifically, it becomes stagnant in the adjacencies of the step (more concretely, riser portion of step) which is present between the bottom surface of the developer chamber of the developer container 11 and the bottom surface of the developer discharge passage 11. As the stagnant developer increases, it prevents the developer from being smoothly discharged. In the space H, there is the riser portion of the step, which has the height of Z. Therefore, the excessive amount of developer, which moved over the collar-like section 154, but did not enter the discharge passage entrance 17, collects, and becomes stuck, in the adjacencies of the step.

The developing devices structured as disclosed in Patent Documents 1 and 2 do not have means for conveying the developer which collected in the adjacencies of the above-described step. Thus, the body of developer which became stuck in the adjacencies of the step continues to grow, and makes the developing devices unstable in terms of the discharging of the excessive amount of developer.

As described previously regarding the problems which conventional developing devices suffer, the present invention is effective to deal with the developer stagnation which occurs in the space H between the collar-like section 154 and the upstream end of the developer container 11 in terms of the developer conveyance direction of the second spiral section 152. Thus, in this embodiment, the surface of the collar-like section 154, which directly faces the developer discharge passage 11*c* is provided with an appendage (protrusion 155), which extends not only in the upstream direction in terms of the developer conveyance direction of the second spiral section 152, but also, in the radius direction of the collar-like section 154, partially beyond the circumference of the projection of the developer discharge passage 11*c* upon the collar-like section 154. In other words, the protrusion 155 is a part of the collar-like section 154, and protrudes in the direction parallel to the axial line of the second conveyance screw 15.

By providing the collar-like section 154 with the protrusion 155, which protrudes toward the discharge passage entrance 17, it is made possible to scrape away the developer which collects in the adjacencies of the aforementioned step of the area H. With the provision of this protrusion, it is ensured that as the developer travels beyond the collar-like section 154, it is smoothly conveyed to the developer discharge passage 11*c*. Therefore, it is possible to properly discharge the excessive amount of developer.

Hereafter, a few of the preferred embodiments of the present invention are described. However, the shape, positioning, etc., of the structural components of the developing devices in the following embodiments of the present invention are not intended to limit the present invention in scope unless specifically noted.

Embodiment 1

Part (a) of FIG. 6 is a perspective view of the second conveyance screw 15 having the protrusion 155 which is in the form of a rectangular parallelepiped. Part (b) of FIG. 6 is a drawing of the second conveyance screw 15 as seen from the direction indicated by an arrow mark D in part (a) of FIG. 6. Part (c) of FIG. 6 is a drawing of the second conveyance screw 15 as seen from the direction indicated by an arrow mark E in part (a) of FIG. 6. The line C in part (c) of FIG. 6 is the outward contour of the third spiral section 153. Referring to FIG. 6, in this embodiment, the second conveyance screw 15 is provided with such a protrusion that protrudes not only outward in the radius direction of the second conveyance screw 15 beyond the outward contour C of the third spiral section 153, but also, toward the developer discharge passage 11*c*. Therefore, it is capable of scraping away the developer as the developer collects in the areas H in FIGS. 3 and 5.

Referring to part (a) of FIG. 6, in terms of the radius direction of the second conveyance screw 15, the protrusion 155 is uniform in dimension. However, it may be different. Further, the protrusion 155 does not need to be in the form of a rectangular parallelepiped. That is, the protrusion 155 may be in any form, as long as it covers the same area in terms of the radius direction of the second conveyance screw 15 as the rectangular parallelepiped in this embodiment. For example, it may be in the form of a main section of a Japanese foldable fan, as shown in part (a) of FIG. 7. Further, the collar-like section 154 may be provided with two or more protrusions.

Further, the protrusion 155 may be such that it extends all the way from the center of the collar-like (disc-like) section 154 to the outer edge of the collar-like (disc-like) section 154. By the way, regarding the length and sweeping range of the protrusion 155 in terms of the radius direction of the collar-like section 154, the protrusion 155 is effective as long as it extends beyond the outward contour C. Thus, it may be such that it covers only a part of the area between the outward edge of the collar-like section 154 and the outward contour C of the third spiral section 153 as shown in part (b) of FIG. 7. Further, it may be such that it extends beyond the outer edge of the disk-like section 154 as shown in part (c) of FIG. 7. That is, the outward edge of the protrusion 155 in terms of the radius direction of the second conveyance screw 15 may be protrusive beyond the outer edge of the disc-like section 154.

Regarding the rotational phase of the protrusion 155, from the standpoint of efficiently conveying the developer after the developer is scraped away by the protrusion 155, it is desired that the position of the protrusion 155 relative to the third spiral section 153 is such that the protrusion 155 is in a range of −30°-+90° from the upstream edge of the third spiral section 153 in terms of the developer conveyance direction of the third spiral section 153, assuming that the rotational direction of the second conveyance screw 15 is the positive rotational direction. However, it may be otherwise.

The above-described first embodiment is effective to deal with the developer which collects in the adjacencies of the step portion of the space H (H1 and H2) between the collar-like section 154 and the rear end wall of the developer chamber of the developer container 11. That is, the collar-like section 154 is provided with the protrusion 155 which protrudes toward the discharge passage entrance 17. Thus, it is possible to scrape away the developer which collects in the step portion of the space H, and cannot be scraped way if the developer were in a conventional developing device.

Moreover, the protrusion 155 which is an integral part of the second conveyance screw 15 and rotates with the second conveyance screw 15 can scoop up the developer in the adjacencies of the step, and therefore, can guide the developer to the developer discharge passage 11*c* as the developer collects in the adjacencies of the step.

Regarding the collection of the developer, if there is such a point that triggers the developer collection, the collection grows around this point, and eventually, the developer collection begins to interfere with the discharging of the excessive amount of developer. Thus, by improving the developing device in terms of the state of collection of the developer in the adjacencies of the above-described step of the area H, which could be the point that triggers developer collection, it is possible to solve the above-described problem. That is, it is possible to make a developing device stable in the amount by which the excessive amount of developer in the developing device is discharged, even when the developing device is continuously operated for a long time in an environment which is high in temperature and humidity. Therefore, it is possible to enable a developing device to deal with various environments in which it used, and also, various state of two-component developer. Stabilizing a developing device in the amount by which the excessive amount of developer therein is discharged leads to the prevention of the fluctuation in the amount of the developer in the developer container, and therefore, can make it possible to provide a developing device which is capable of enabling an image forming apparatus to reliably output high quality images for a long period of time.

Embodiment 2

In the first embodiment, the collar-like section 154 was shaped so that the protrusion 155 clearly protrudes from the main section of the collar-like section 154. However, instead of providing the collar-like section 154 with the protrusion 155, the collar-like section 154 may be shaped so that the surface of the collar-like section 154, which faces the developer discharge passage 11*c*, is tilted as shown in part (a) of FIG. 8. The effects of such a collar-like section 154 are the same as those of the collar-like section 154 in the first embodiment.

Part (b) of FIG. 8 is a sectional view of the second conveyance screw 15, at a plane which is perpendicular to the axial line of the second conveyance screw 15, as seen from the direction indicated by an arrow mark in part (a) of FIG. 8. As is evident from part (b) of FIG. 8, a hashed area G, which corresponds to the hashed area in FIG. 7, partially protrudes in the radius direction, on the outward side of the contour C. Therefore, the collar-like section 154 in this embodiment can scrape away the developer like the collar-like section 154 in the first embodiment which has the protrusion 155, as the developer collects in the area H.

Embodiment 3

In a case where a part of the spiral blade, which is in the adjacencies of the joint between the third spiral section 153 and collar-like section 154, is greater in diameter than the spiral blade in the developer conveyance passage, the portion of the spiral blade, which is on the outward side of the blade contour C may be deemed as a protrusion which is on the outward side of the blade contour C in terms of the radius direction of the second conveyance screw 15. Thus, this section of the spiral blade can provide the same effects as the above-described protrusion 155 in the first embodiment. That is, a developing device may be structured so that the protrusion 155 is made up of the outward extension of the third spiral section 153, in terms of the radius direction of the second conveyance screw 15, at the point between the third spiral section 153 and collar-like section 154.

(Miscellanies)

1) The carrier for the two-component developer may be magnetic or nonmagnetic.

2) In the preceding embodiments, the image forming apparatuses were full-color image forming apparatuses. However, the present invention is also applicable to a black-and-white image forming apparatus.

According to the present invention, it is ensured that as developer moves beyond the disk-like section of the second conveyance screw, it is smoothly and reliably conveyed to the developer discharge outlet, so that the excessive amount of developer is properly discharged. Therefore, it is possible to provide a developing device which can prevent the developing device from fluctuating in the amount of the developer in its developer container, and therefore, can enable an image forming apparatus to reliably output high quality images for a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-009251 filed on Jan. 21, 2015, which is hereby incorporated by reference herein in its entirety.

What is claimed is:

1. A developing device comprising:

a developer carrying member for carrying a two component developer comprising toner and carrier;

a first chamber configured to accommodate the developer;

a second chamber in fluid communication with said first chamber to constitute a circulation path along which the developer circulates;

a partition for partitioning between said first chamber and said second chamber;

a first feeding member rotatably provided in said first chamber and configured to feed the developer in a first direction;

a second feeding member rotatably provided in said second chamber and configured to feed the developer, said second feeding member including a first spiral portion configured to feed the developer in a second direction opposite to the first direction, a second spiral portion provided downstream of said first spiral portion with respect to the second direction to feed the developer in the first direction, a disk portion provided downstream of said second spiral portion with respect to the second direction, and a shaft portion provided downstream of said second spiral portion with respect to the second direction;

a discharge opening provided at a position downstream of said disk portion with respect to the second direction and configured to discharge the developer;

a stepped portion provided in said second chamber at a position downstream of said disk portion and upstream of said discharge opening with respect to the second direction, said stepped portion having a height high enough to oppose a lateral surface of said disk portion; and a projected portion projected from a part of said disk portion that opposes said stepped portion.

2. A device according to claim 1, wherein said projected portion extends from a center portion of the disk portion to a circumferential end surface of said disk portion.

3. A device according to claim 1, wherein said projected portion has a radially outside end surface which is outward of an outer diameter of said disk portion.

4. A device according to claim 1, wherein said projected portion is a part of said disk portion.

5. A device according to claim 1, wherein said shaft portion is provided with a third spiral portion configured to feed the developer in the second direction.

6. A device according to claim 5, wherein a phase of an upstream end of said third spiral portion is within a range of −30-+90 degrees from a phase of said projected portion, where a rotational moving direction of said second feeding member is positive.

7. A device according to claim 5, wherein a connecting portion of said projected portion relative to said disk portion extends outwardly beyond a spiral diameter in a developer discharging path.

8. A device according to claim 1, wherein said developing device is capable of being supplied with the two-component developer.

* * * * *